US006165006A

United States Patent [19]

Yeh et al.

[11] Patent Number: 6,165,006

[45] Date of Patent: Dec. 26, 2000

[54] CABLE CONNECTOR

[75] Inventors: Joel Jyh-Haur Yeh, Diamond Bar; Henry Chen, Anaheim, both of Calif.

[73] Assignee: Hon Hai Precision Ind. Co., Ltd., Taipei Hsien, Taiwan

[21] Appl. No.: 09/173,986

[22] Filed: Oct. 16, 1998

[51] Int. Cl.[7] ..... H01R 3/00

[52] U.S. Cl. ..... 439/490

[58] Field of Search ..... 439/488, 490, 439/358, 357, 489, 910; 362/95; 340/815.42, 815.45

[56] References Cited

U.S. PATENT DOCUMENTS

| | | | |
|---|---|---|---|
| 4,386,818 | 6/1983 | Millhimes et al. | 439/490 |
| 5,320,560 | 6/1994 | Fladung | 439/490 |
| 5,780,775 | 7/1998 | Yu | 174/135 |
| 5,797,771 | 8/1998 | Garside | 439/610 |
| 5,876,240 | 3/1999 | Derstine et al. | 439/490 |
| 5,885,100 | 3/1999 | Talend et al. | 439/490 |

*Primary Examiner*—Brian Sircus
*Assistant Examiner*—Chandrika Prasad
*Attorney, Agent, or Firm*—Wei Te Chung

[57] ABSTRACT

A cable plug connector for engaging with a PCMCIA I/O card consists of a housing having an upper wall defining an opening, a lower wall, a front end for proximity to the I/O card and a rear end from which wires of a cable extend into the connector. A printed circuit board (PCB) is fixedly received in the housing. A light-emitting diode (LED) is soldered to the PCB. A connector body is fixed to the front end of the housing and defines a number of contact passageways therein. A number of contacts each have a contact portion fixedly received in the corresponding contact passageway and a tail portion soldered to the PCB. A metallic shielding defining an opening is mounted to the connector body and covers the PCB, wherein the opening of the shielding is aligned with the LED and the opening in the upper wall of the housing. A light pipe made of transparent/translucent material is fixed to the upper wall of the housing and has an upper portion extending through the opening therein and an lower portion extending through the opening in the shielding to contact with the LED, whereby light emitted by the LED can be transmitted to an upper side of the housing.

17 Claims, 6 Drawing Sheets

CABLE CONNECTOR

BACKGROUND OF THE INVENTION

1. Field of the Invention

The present invention relates to a cable connector, and particularly to a cable plug connector for connecting with a PCMCIA I/O card.

2. The Prior Art

Referring to FIG. 1, to connect a computer 504 with a network 500 such as a telephone network, a PCMCIA I/O card 502 is inserted into a PCMCIA connector (not shown) mounted in the computer 504. The I/O card 502 has a 68-position connector (not shown) connected with the PCMCIA connector, and a 15-position connector (not shown) exposed to an exterior of the computer 504. A cable 506 with a first end provided with a plug connector 508 and a second end provided with a dungle 510 (usually including a receptacle RJ45/RJ11 modular jack (not shown)) connects the I/O card 502 with the network 500 by engaging the plug connector 508 with the 15-position connector of the I/O card 502 and the dungle 510 with a mating plug modular jack 512 of another cable 514 which has another plug modular jack 516 on the other end engaging with the network 500. To indicate the communication status between the computer 504 and the network 500, at least one LED 518 is provided on the dungle 510.

Such a prior art requires two cables 506, 514 to connect the computer 504 with the network 500. In addition, the dungle 510 must be relatively bulky in order to accommodate the receptacle RJ45/RJ11 and a printed circuit board (not shown) having the LED 518 mounted thereon.

To overcome the above mentioned disadvantages, an incorporation of two LEDs 520 into a cable plug connector 522 has been proposed, as seen in FIG. 2, in which a housing and some other parts of the connector 522 have been removed for clarity. The two LEDs 520 are soldered to wires 524 each having a predetermined length. The wires 524 are soldered to contacts 528 of the connector 522 whereby the LEDs 520 extend out of a rear side of the housing (not shown) of the connector 522. By such a design, the other end (not shown) of a cable 530 connecting with the plug connector 522 can be provided with a plug modular jack (not shown) to directly connect with a network without the necessity of an additional cable.

However, in such a prior art it is laborious to solder the LEDs 520 to the wires 524 and then solder the wires 524 to the contacts 528 of the connector 522. Additionally, since the LEDs 520 are located on a rear side of the connector 522, it is difficult to identify the communicating status indicated by the LEDs 520. Moreover, since the wires 524 are deformable, the distance that the LEDs 520 extend outside the housing of the connector 522 cannot be easily controlled, thus the indicating effectiveness achieved thereby is not always good. Finally, since the LEDs 520 extend outside the housing of the connector 522, the aesthetic integration of the connector 522 is unfavorably affected.

Hence, an improved cable plug connector for connecting with a PCMCIA I/O card is needed to eliminate the above mentioned defects of the current art.

SUMMARY OF THE INVENTION

Accordingly, an objective of the present invention is to provide a cable plug connector for engaging with a PCMCIA I/O card having at least one indicating device which can be easily mounted to the connector.

Another objective of the present invention is to provide a cable plug connector for engaging with a PCMCIA I/O card having at least one indicating device exposed to an upper side of a housing thereof whereby a user can easily identify the communicating status between a computer and the network connected together by a cable having the connector.

A further objective of the present invention is to provide a cable plug connector for engaging with a PCMCIA I/O card having at least one indicating device having an upper side flush with an upper face of a housing of the connector whereby the connector has an integral appearance, and the indicating effectiveness achievable by the indicating device is ensured to be uniformly good.

To fulfill the above mentioned objectives, according to one embodiment of the present invention, a cable plug connector for engaging with a PCMCIA I/O card consists of a housing having an upper member defining an opening and a lower member, a printed circuit board (PCB) mounted in the housing, an LED soldered to the PCB, a number of contacts each having a contact portion fixedly received in a connector body fixed to a front side of the housing for engaging with the PCMCIA I/O card and a tail portion soldered to the PCB, two lock-in plates drivably mounted in the housing each having a latching projection for fixedly engaging with the I/O card, a metallic shielding mounted in the housing and defining an opening aligned with the opening of the upper member of the housing and the LED, and a transparent/translucent light pipe fixed to the upper member of the housing and having an upper face extending through the opening to be flush with an upper surface of the upper member of the housing, and a lower portion extending through the opening of the shielding and contacting the LED.

DETAILED DESCRIPTION OF THE PREFERRED EMBODIMENT

Reference will now be made in detail to the preferred embodiment of the present invention.

Figure 1:
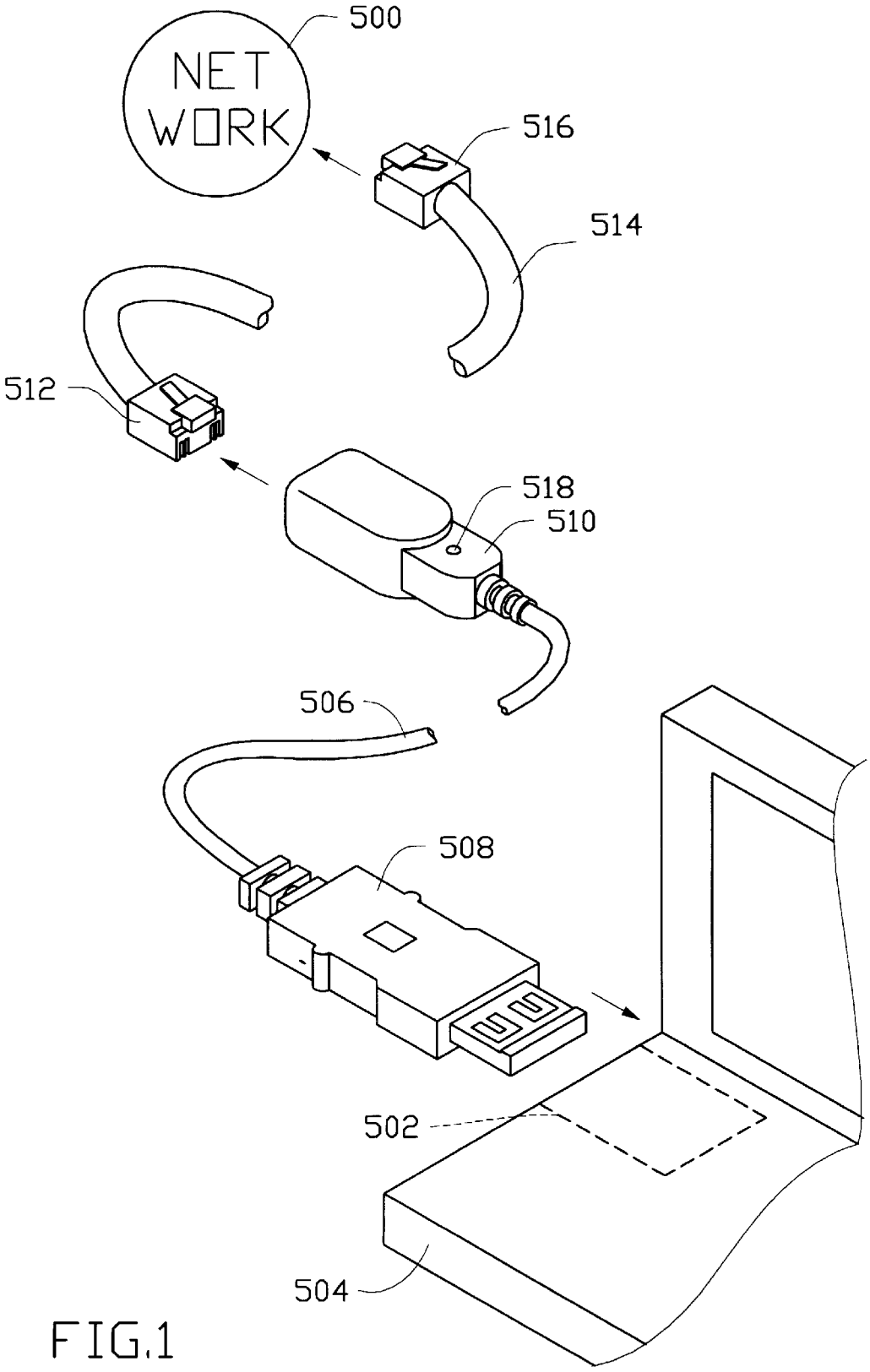
FIG.1 (PRIOR ART)
FIG. 1 is a perspective view of a prior art cable having a cable plug connector at one end for engaging with a PCMCIA I/O card received in a computer and a dungle at the other end for connecting with another cable to connect with a network.
Figure 2:
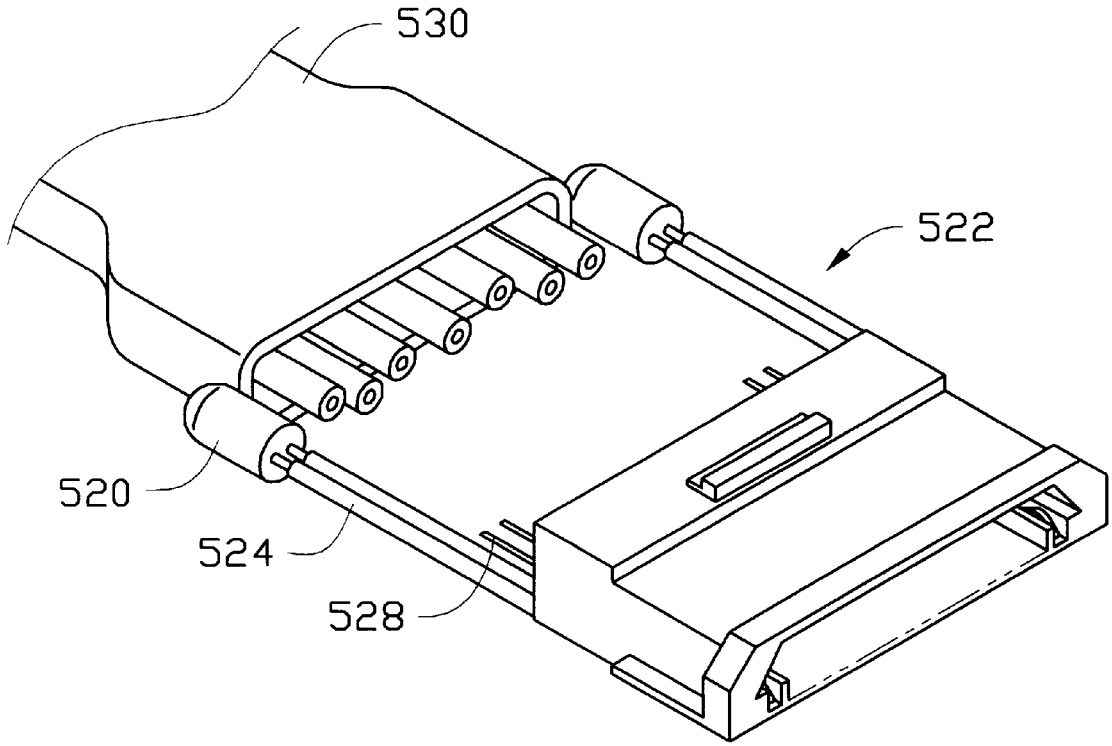
FIG.2 (PRIOR ART)
FIG. 2 is a partially cut-away perspective view of another prior art cable plug connector.
Figure 3:
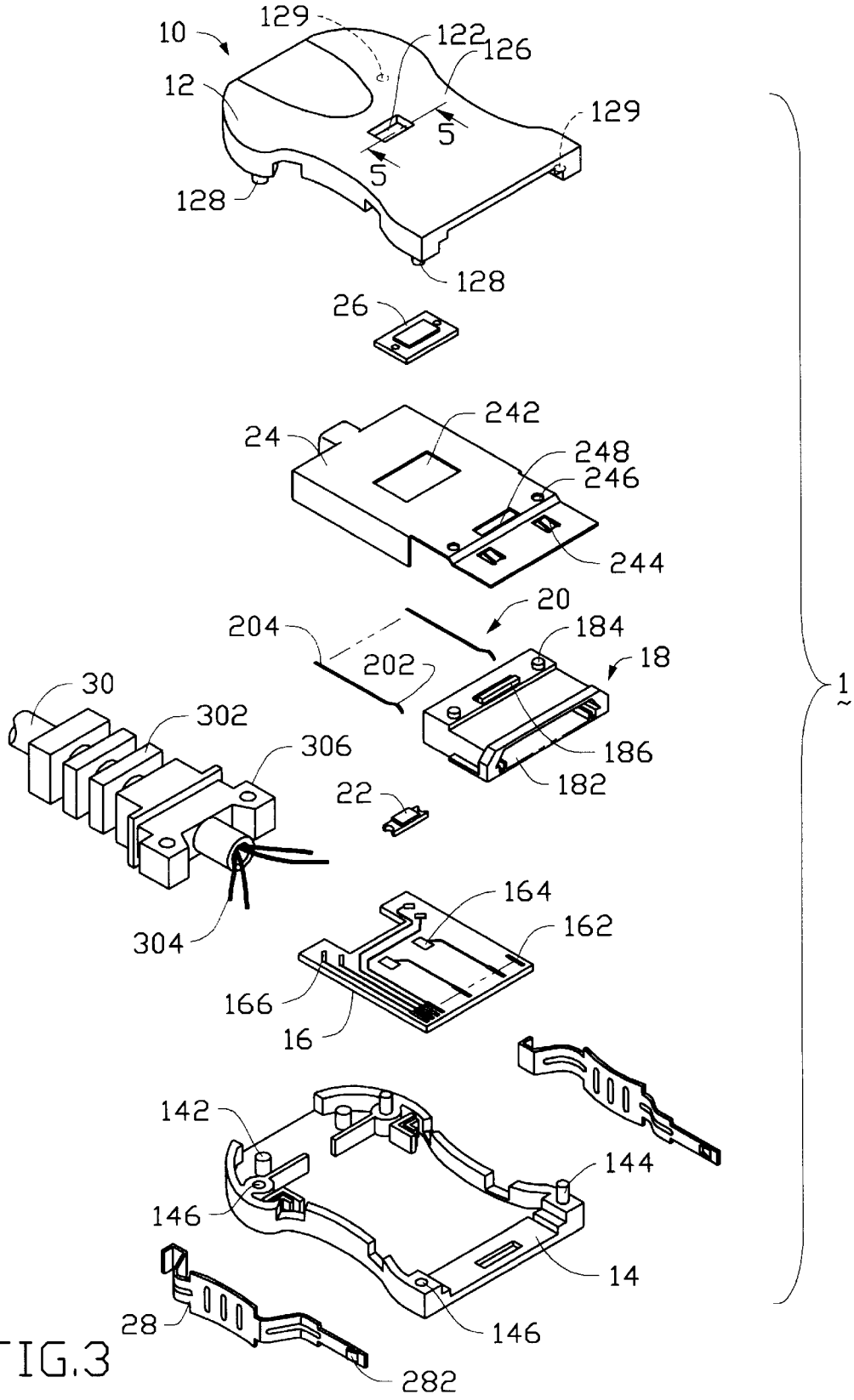
FIG. 3 is an exploded, perspective view of a cable plug connector in accordance with the present invention.
Figure 5:
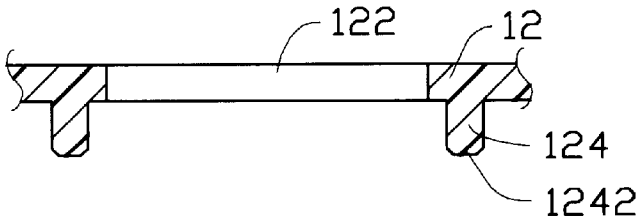
FIG. 5 is an enlarged cross-sectional view taken along line 5—5 of FIG. 3.

Referring to FIG. 3, a cable plug connector 1 in accordance with the present invention for engaging with a PCMCIA I/O card (not shown) generally consists of a dielectric housing 10 including an upper member 12 defining a rectangular opening 122 and two mounting posts 124 (FIG. 5) extending downwards from opposite lateral sides of the opening 122 and a lower member 14. A printed circuit board (PCB) 16 has a number of front golden fingers 162, two middle contact pads 164 connecting with two of the golden fingers 162, and four rear contact pads 166 connecting with four of the golden fingers 162. A dielectric connector body 18 defines a number of contact passageways 182 therein. A number of contacts 20 each have a contact portion 202 for engaging with the I/O card, and a tail portion 204. An LED 22 is soldered to the two middle contact pads 164 of the PCB 16 by SMT (surface mounting technology). A metallic shielding 24 defines a rectangular opening 242 and forms two grounding tabs 244 for engaging with a metallic shell of the I/O card.

Figure 4A:
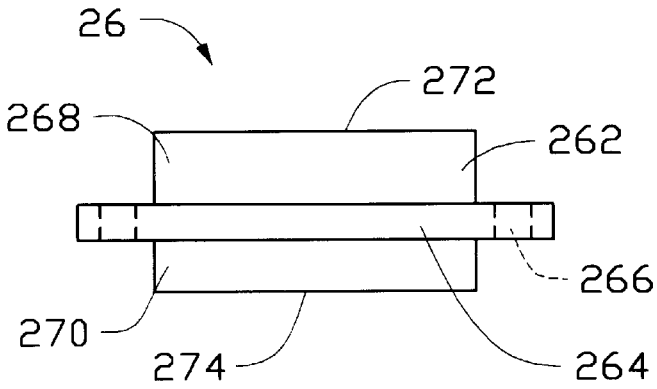
FIG. 4A is an enlarged elevational view of a light pipe of the cable plug connector of the present invention.
Figure 4B:
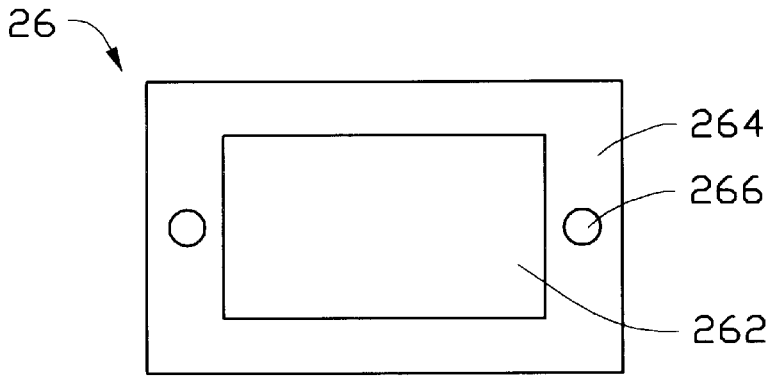
FIG. 4B is a top view of FIG. 4A.

Also referring to FIGS. 4A and 4B, a light pipe 26 made of transparent/translucent plastic has a rectangular configuration with a central body 262 and a peripheral flange 264 around the body 262. The flange 264 defines two holes 266 in lateral sides thereof. Two lock-in plates 28 each define a latching projection 282 at a front end thereof for releasably engaging with the I/O card. A cable 30 has a strain relief 302 and four wires 304 extending therefrom.

Figure 6:
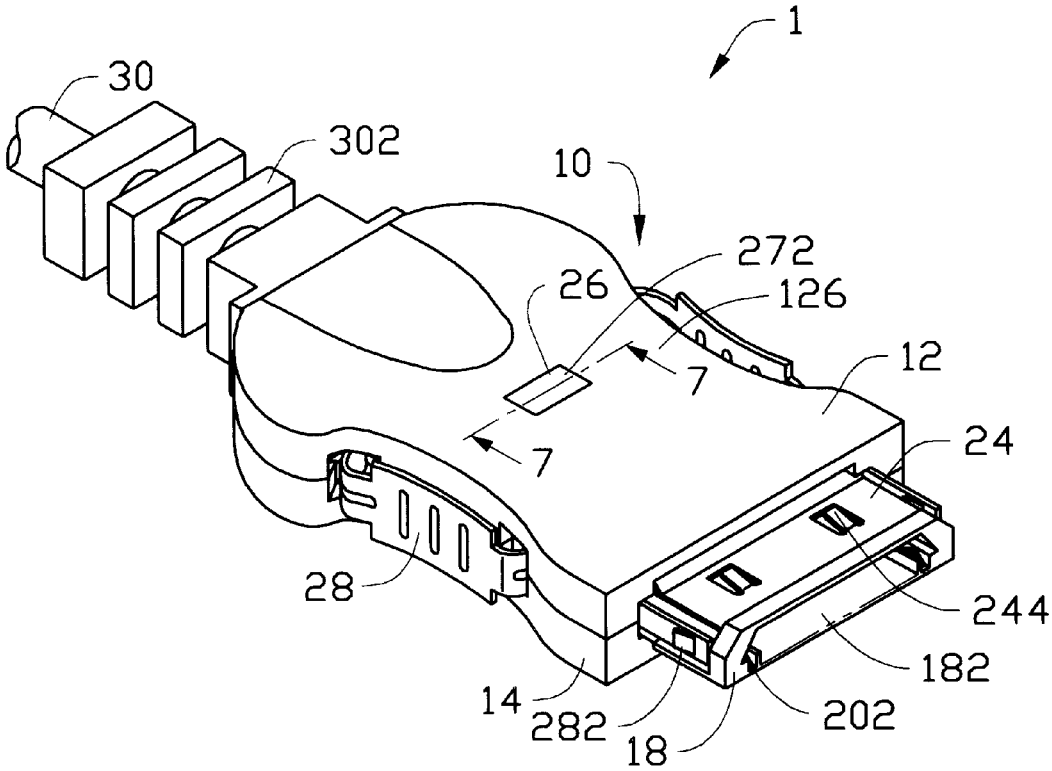
FIG. 6 is a perspective view of the assembled connector of FIG. 3.
Figure 7:
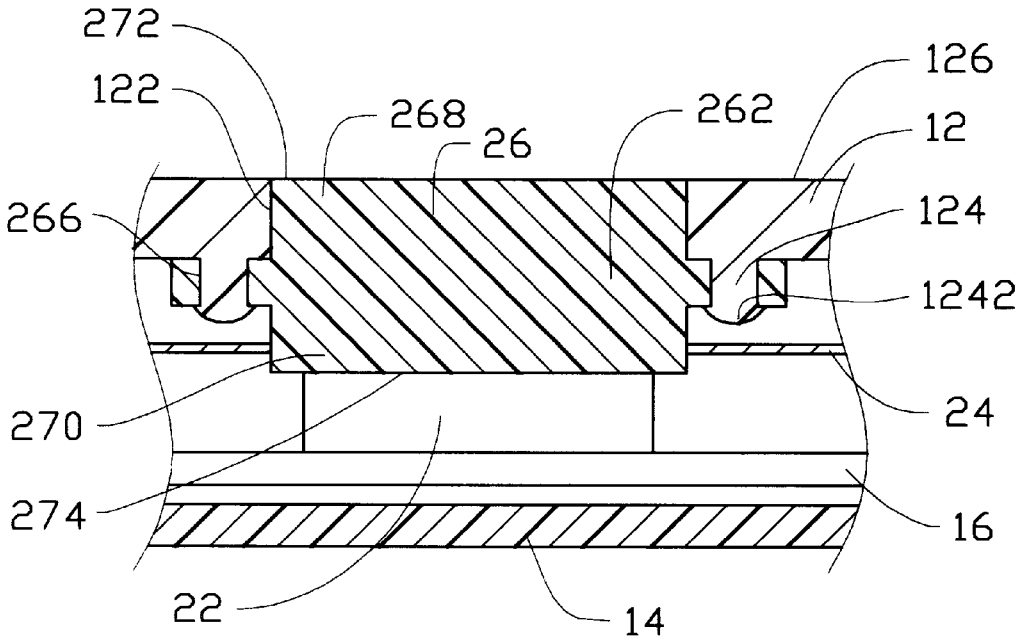
FIG. 7 is an enlarged cross-sectional view taken along line 7—7 of FIG. 6.

To assemble the connector 1, also referring to FIGS. 6 and 7, the light pipe 26 is assembled to the upper member 12 of the housing 10 by extending the two mounting posts 124 of the upper member 12 through the holes 266 of the light pipe 26 and an upper portion 268 of the body 262 of the light pipe 26 through the opening 122 of the upper member 12 to reach a position where a top face 272 of the light pipe 26 is flush with a top surface 126 of the upper member 12 of the housing 10. A free end 1242 of each mounting post 124 is subject to a heat-pressure operation to form an enlarged end thereby fixing the light pipe 26 to the upper member 12 of the housing 10.

The contact portions 202 of the contacts 20 are fixedly received in the contact passageways 182 of the connector body 18 and the tail portions 204 thereof are soldered to the corresponding golden fingers 162 of the PCB 16. The wires 304 of the cable 30 are soldered to the corresponding rear contact pads 166 of the PCB 16. The metallic shielding 24 is mounted to the connector body 18 by respectively fitting two side studs 184 and a middle rectangular protrusion 186 of the connector body 18 into two side round holes 246 and a middle rectangular hole 248 defined in a front portion of the shielding 24 to reach a position where the shielding 24 covers the PCB 16 and a rectangular opening 242 defined therein is in alignment with the LED 22.

The subassembly of the cable 30, PCB 16, LED 22, contacts 20, connector body 18 and shielding 24 is mounted to the lower member 14 of the housing 10 by fitting ears 306 of the strain relief 302 into two pins 142 formed on a rear portion of the lower member 14 of the housing 10. The two lock-in plates 28 are then mounted to two lateral sides of the lower member 14 of the housing 10 to reach a position wherein the latching projections 282 thereof are located beside the connector body 18. The details of the mounting of the lock-in plates 28 in the housing 10 and their functions are disclosed in U.S. Pat. No. 5,749,746 assigned to the assignee of the present invention, which is wholly incorporated herein for reference.

Finally, the upper member 12 of the housing 10 is assembled to the lower member 14 by fitting mounting rods 128, 144 on the upper and lower members 12, 14, respectively, into mating holes 146, 129 therein to reach a position where a lower portion 270 of the body 262 of the light pipe 26 extends through the rectangular opening 242 of the shielding 24 and a bottom face 274 thereof contacts the LED 22, whereby light emitted by the LED 22 can be transmitted to an upper side of the housing 10 to be observed by a user.

One feature of the invention is to provide a connector with an identification device, i.e., LED, which is soldered to a printed circuit board for electrically connecting to the corresponding contacts/wires instead of being directly soldered to the contacts/wires. Moreover, said LED is embedded within the housing without enlarging the dimension of the housing or complicating/uglifying the contour of the housing. Additionally, it is easy for the user to observe the upward facing LED through the opening in the upper wall and the corresponding light pipe.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A cable plug connector for connecting with an I/O card, comprising:

a dielectric housing defining a front end for proximity to an I/O card, a rear end opposite the front end and upper and lower walls between the front and rear ends, said upper wall defining an opening;

a printed circuit board received in the housing;

an LED mounted on the printed circuit board;

a connector body fixed to the front end of the housing and defining a number of contact passageways therein;

a number of contacts each having a contact portion received in the corresponding contact passageway and a tail portion soldered to the PCB; and a light pipe made of transparent/translucent material having a first portion extending through the opening in the upper wall of the housing and a second portion in contact with the LED.

2. The cable plug connector in accordance with claim 1 further comprising a metallic shielding located between the PCB and the upper wall of the housing, wherein the second portion of the light pipe extends through the metallic shielding to contact the LED.

3. The cable plug connector in accordance with claim 1, wherein the light pipe has a top face flush with a top surface of the upper wall of the housing whereby the connector has an integral appearance.

4. The cable plug connector in accordance with claim 1, wherein the LED is mounted to the PCB by surface mounting technology.

5. The cable plug connector in accordance with claim 1 further comprising a cable with wires extending from a rear end thereof into the housing to be electrically connected to the PCB.

6. The cable plug connector in accordance with claim 5 wherein the LED is located between the wires and the tail portions of the contacts.

7. The cable plug connector in accordance with claim 1 further comprising a pair of lock-in plates having latching projections for releasably engaging with an I/O card.

8. The cable plug connector in accordance with claim 1, wherein the shielding further comprises grounding tabs for engaging with a metallic shell of an I/O card.

9. The cable plug connector in accordance with claim 1, wherein the light pipe has a substantially rectangular configuration with a central body and a peripheral flange having a thickness smaller than that of the body.

10. The cable plug connector in accordance with claim 9, wherein the upper wall of the housing forms a mounting post extending through the peripheral flange, the mounting post having an enlarged free end fixedly attaching the light pipe to the upper wall of the housing.

11. The cable plug connector in accordance with claim 1, wherein the light pipe is made of plastic.

12. A connector comprising:

a dielectric housing defining a front end and a rear end, an upper wall positioned between the front end and the rear end;

an upward facing opening formed in the upper wall and extending therethrough in a vertical direction;

a connector body disposed at the front end of the housing and enclosing a number of contacts therein, said contacts extending in a horizontal direction perpendicular to said vertical direction; and an LED positioned in the housing for being electrically affected by mating of the contacts with a corresponding complementary connector, said LED is easily observed and a status of mating of the contacts is obtained; and a light pipe being provided within the housing, one portion of which extends through the opening and the other portion of which contacts the LED.

13. The connector in accordance with claim 12, wherein a printed circuit board is positioned in the housing and below the upper wall, and said contacts and said LED are mounted to said printed circuit board.

14. The connector in accordance with claim 12, wherein said LED is generally vertically aligned with said opening in the upper wall.

15. The connector in accordance with claim 12, wherein said connector further includes a metallic shielding under the upper wall, and said shielding includes an opening in vertical alignment with said opening in the upper wall.

16. A connector comprising:

a dielectric housing defining a first end and a second end;

a printed circuit board positioned between said first end and said second end;

a plurality of first conductors electrically connected to said printed circuit board around the first end of the housing;

a plurality of second conductors electrically connected to said printed circuit board around the second end of the housing where a connector body is disposed in a horizontal direction; and an identification device positioned on the printed circuit board wherein said identification device is electrically connected to said first conductors to identify a mating status of the connector, said housing comprising an upper wall above the printed circuit board, said upper wall including an opening extending in a vertical direction perpendicular to said horizontal direction to expose light emitted by the identification device.

17. The connector in accordance with claim 16, wherein said first conductors are contacts, said second conductors are wires and said identification device is an LED.

* * * * *